US006829848B2

(12) United States Patent
Gallegos

(10) Patent No.: US 6,829,848 B2
(45) Date of Patent: Dec. 14, 2004

(54) ROTATING PIVOT FOR SHOE

(75) Inventor: Alvaro Gallegos, Albuquerque, NM (US)

(73) Assignee: Z-COIL, Albuquerque, NM (US)

( * ) Notice: Subject to any disclaimer, the term of this patent is extended or adjusted under 35 U.S.C. 154(b) by 55 days.

(21) Appl. No.: 10/247,365

(22) Filed: Sep. 20, 2002

(65) Prior Publication Data

US 2004/0055181 A1 Mar. 25, 2004

(51) Int. Cl.[7] ..... A43B 13/00; A43B 5/00; A43B 21/24

(52) U.S. Cl. ..... 36/103; 36/114; 36/134; 36/39; 36/128

(58) Field of Search ..... 36/103, 114, 134, 36/136, 31, 39, 71, 130, 128, 83

(56) References Cited

U.S. PATENT DOCUMENTS

| | | | | | |
|---|---|---|---|---|---|
| 1,649,294 | A | * | 11/1927 | Eichorn | 36/39 |
| 2,109,712 | A | | 3/1938 | Schmalz | |
| 3,081,562 | A | * | 3/1963 | Oakley | 36/8.3 |
| 3,091,043 | A | | 5/1963 | McCorkle | |
| 3,181,254 | A | * | 5/1965 | Cowen | 36/39 |
| 3,204,348 | A | | 9/1965 | Latson | |
| 3,354,561 | A | * | 11/1967 | Cameron | 36/134 |
| 3,680,231 | A | * | 8/1972 | Dymond | 36/113 |
| 3,707,047 | A | * | 12/1972 | Nedwick | 36/134 |
| 3,757,437 | A | * | 9/1973 | Cameron | 36/134 |
| 3,824,710 | A | * | 7/1974 | Egtvedt | 36/132 |
| 4,271,610 | A | * | 6/1981 | Parrent | 36/136 |
| 5,392,537 | A | * | 2/1995 | Goldberg | 36/134 |
| 5,435,079 | A | | 7/1995 | Gallegos | |
| 5,566,478 | A | * | 10/1996 | Forrester | 36/134 |
| 5,826,352 | A | * | 10/1998 | Meschan et al. | 36/31 |
| 6,035,559 | A | * | 3/2000 | Freed et al. | 36/134 |

FOREIGN PATENT DOCUMENTS

| | | | | |
|---|---|---|---|---|
| DE | 36 22 844 A1 | | 1/1988 | |
| WO | WO 92/10954 A1 | * | 7/1992 | A43B/5/00 |
| WO | WO 93/12682 | | 7/1993 | |
| WO | WO 00/64295 | | 11/2000 | |

* cited by examiner

*Primary Examiner*—Anthony Stashick
(74) *Attorney, Agent, or Firm*—Oliff & Berridge, PLC

(57) ABSTRACT

A shoe sole includes a rotatable pivot assembly to allow easy pivoting of a ball region of a shoe. The shoe sole includes a pivot cavity defined by an upper plate support surface and a lower plate support surface having an aperture therein. A rotatable pivot assembly includes a pivot plate and a sole element attached thereto. The pivot plate is pivotally constrained within the pivot cavity and the sole element extends through the aperture in the pivot cavity to define an exterior contact surface. Preferably contacting surfaces of the pivot plate and upper plate support surface are formed of a low coefficient of friction material to allow easy rotation of the pivot plate within the cavity. Because the assembly can be made thin with minimal parts, it results in a structure that substantially retains the look, feel and balance of a normal shoe while being able to achieve improved pivot action. The shoe sole is particularly advantageous when incorporated into an athletic shoe or a work shoe for activities that require repeated pivotal movement.

43 Claims, 3 Drawing Sheets

ROTATING PIVOT FOR SHOE

BACKGROUND OF THE INVENTION

1. Field of Invention

The invention relates to a rotating pivot for shoes and shoes incorporating such a rotating pivot.

2. Description of Related Art

Many activities require rapid changes in direction, such as various sports activities including, but not limited to, basketball and tennis. So do various dance activities. Additionally, activities that require repetitive twisting or rotating movements, even if not overly strenuous, exert extreme instantaneous or accumulative forces in the ball region of the foot and corresponding shoe sole area. This is because "normal" shoes have a fixed sole, such that rotation may only be achieved by skidding of the shoe sole exterior surface against the surface of the ground. On high grip surfaces and when high grip shoe soles are provided, such pivoting is difficult and requires much physical exertion of force. It also causes extreme wear and stress on the ball portion of the shoe soles. Moreover, in such high friction environments, extra forces act on a wearer's ankle and ligaments, often resulting in physical injury.

There are known shoes with rotating pivots that assists in rotation of the ball region of a shoe. However, to date, such shoes have required complicated, bulky structures. For example, see U.S. Pat. No. 5,566,478 to Forrester, U.S. Pat. No. 3,354,561 to Cameron, U.S. Pat. No. 2,109,712 to Schmalz, and U.S. Pat. No. 3,204,348 to Latson. Each of these provide a rotatable sole surface that allows for easier pivoting movement. However, each of these also suffer from severe side effects. All require a rather bulky and thick pivot assembly. This requires a corresponding thick shoe sole, which limits its application. The resultant shoe structure also is awkward, clunky, heavy and often unsightly. Such a heavy construction also effects the balance, flexibility and "feel" of the shoe, making it feel unnatural compared to a "normal" shoe. As such, such prior shoes may change or alter the running or walking gait.

SUMMARY OF THE INVENTION

There is a need for an improved rotating pivot for a shoe with a simpler, less complex construction that can be easily incorporated into a shoe structure.

There also is a need for an improved rotating pivot for a shoe with a reduced weight and bulk so as to minimize its affect on the balance and feel of the shoe.

There also is a need for an improved rotating pivot for a shoe that has a reduced thickness so that it is less intrusive on the design and size of a shoe sole, allowing it to be used on shoes of varying thickness and also allowing the pivot to have minimal effect on the resiliency or cushioning effect of the sole as compared to other portions of the sole.

There also is the need for an improved rotating pivot that will not change or alter a wearer's running or walking gait.

The present invention provides a shoe sole and shoe that includes a main sole having a pivot cavity and a rotatable pivot assembly including a sole element and a pivot rotatably pivotally contained within the pivot cavity. The pivot plate has a diameter that is larger than an open aperture in the cavity and the sole element is smaller than the aperture.

BRIEF DESCRIPTION OF THE DRAWINGS

The foregoing and further objects, features and advantages of the invention will become apparent from the following description of preferred embodiments with reference to the accompanying drawings, wherein like numerals are used to represent like elements and wherein.

DETAILED DESCRIPTION OF PREFERRED EMBODIMENTS

Figure 1:
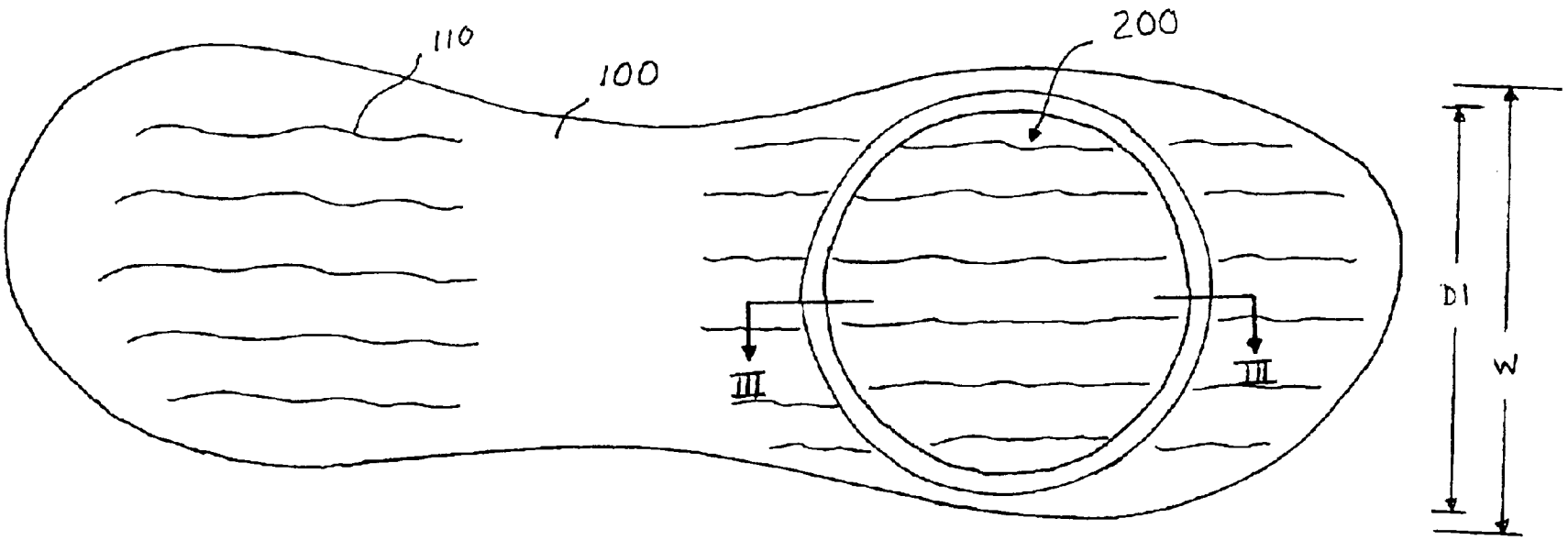
FIG. 1 shows a bottom view of a shoe sole incorporating a rotating pivot according to the invention.
Figure 2:
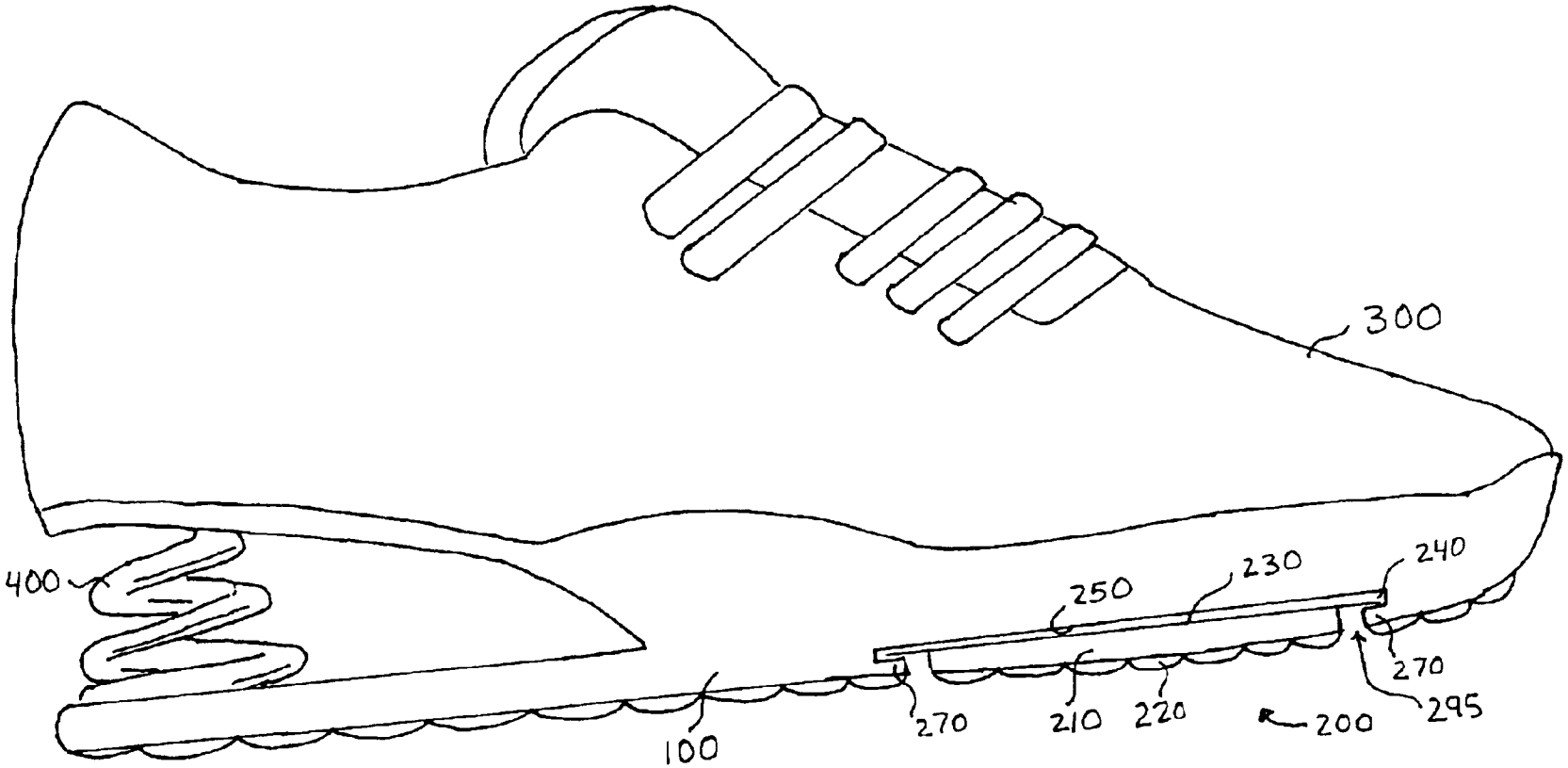
FIG. 2 shows a side view of the shoe of FIG. 1 according to the invention.
Figure 3:
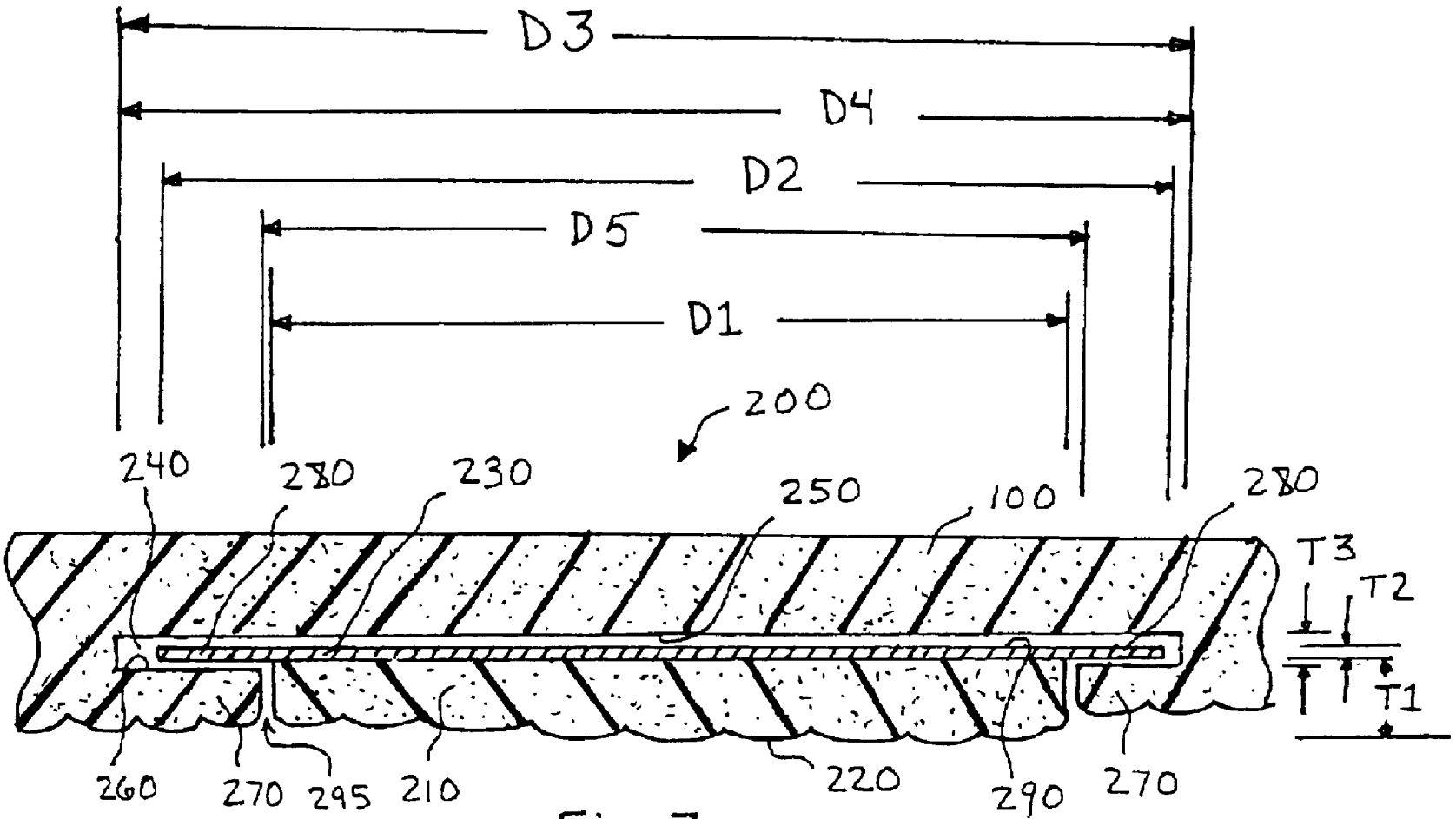
FIG. 3 shows a partial cross-sectional view of the shoe sole of FIG. 1 taken along lines III—III.

An exemplary embodiment of a rotating pivot for a shoe according to the invention will be described with reference to FIGS. 1–3. In FIG. 1, a sole 100 is provided, which has an exterior sole surface 110 that may include a tread design, and a rotatable pivot assembly 200 provided in a ball region of sole 100. As better shown in FIGS. 2–3, rotatable pivot assembly 200 includes a pivotal sole element 210 having an external contact surface 220 and a pivot plate 230 attached to sole element 210. Attachment may be by any suitable known or subsequently developed method, including bonding, fixing, gluing, screwing, nailing, interlocking, integral forming, heavy duty Velcro® attachment, etc. Attachment may be permanent or removable. For example, it may be desirable to make the attachment removable so as to be able to replace a worn sole element 210 or to accommodate a different type or style of pivotal sole element 210, with either a different tread pattern, different composition, hardness, grip, etc.

Pivotal sole element 210 is formed of a suitable material and has a diameter D1 and a thickness T1 sufficient so that external contact surface 220 extends to or preferably slightly beyond the exterior sole surface of sole 100. In an exemplary embodiment, T1 is selected so as to extend between 1–2.5 mm below the surface of main sole 100. Preferably, the sole element 210 is of the same or similar material as that of sole 100. One such suitable material is rubber. However, it is possible to form the sole element of a different material from that of sole 100. For example, it may be desirable to have sole element 210 of a slightly harder material, with primary resiliency and cushioning coming from the remainder of sole 100. It may also be desirable to have the ball region have extra grip and as such, have a sole element 210 formed from a softer or higher coefficient of friction material. External contact surface 220 of sole element 210 also preferably has a similar tread pattern as that of sole 100 for a more uniform appearance and to achieve desired forward and lateral grip. D1 is selected based on the size of the shoe and the particular application. In some applications, D1 may be selected to extend across a substantial majority of the ball region of shoe sole 100 as shown. This is to achieve a large, stable pivot platform for controlled pivotal movement. In most cases, the pivot plate would have a diameter D1 several millimeters, preferably about 4–15 millimeters, short of the full width W of shoe sole 100 to leave about a 5 mm gap between the pivot plate and the outer edge of the shoe. Other applications that also require adequate forward traction and control may benefit from a reduced width D1 that is much smaller than W so that an adequate amount of non-rotatable sole surface 110 in the ball region remains.

Pivot plate 230 has an upper contact surface 290 and a peripheral portion 280 that extends laterally beyond the periphery of sole element 210. Plate 230 has a width D2 and a thickness T2 dimensioned for a particular application and shoe size. D2 will always be slightly larger than D1. T2 should be relatively thin to allow for minimal assembly thickness and minimal interference with the size, fit and operation of shoe sole 100. Thickness T2 is also controlled by material selection so as to retain a sufficient rigidity to substantially maintain its shape and support loads applied thereon. An exemplary thickness T2 is between about 1 and 4 mm. When the pivot plate 230 is made of a rigid material, such as metal or hard plastic, the thickness can be reduced relative to that of other materials and retain a desired stiffness. When less rigid materials are used, the thickness may need to be appropriately increased. One particularly suitable material is Teflon® coated rubber.

Pivot plate 230 is rotatably mounted in pivot cavity 240, which is defined by upper plate support surface 250 and lower plate support surface 260 formed in sole 100. Pivot cavity 240 has a thickness T3 sufficient to loosely receive pivot plate 230 for pivotal rotation therein. As such, T3 will be at least slightly larger than T2. An exemplary thickness T3 is between about 2 and 4.5 mm.

Upper plate support surface 250 has a width D3 that is slightly wider than D2 so as to fully accommodate pivot plate 230 and allow pivotal rotation. Preferably, although not necessarily, upper plate 250 is circular and rigid. Lower plate support surface 260 also has a width D4 that is slightly wider than D2. D4 is preferably the same as D3. All surfaces of contact, such as elements 230, 250 and 260, should be rigid.

Lower plate support surface 260 includes an aperture 295 of diameter D5 sized to rotatably receive pivotal sole element 210 therethrough. D5 should be only slightly larger than D1 so as to allow rotation of pivotal sole element 210 but not form too large of a gap so as to allow entry of foreign matter, such as rocks, dirt, etc. Lower support surface 260 thus forms a circular peripheral sole portion 270 that projects radially inward from the lateral edges of pivot cavity 240 to extend underneath a portion of pivot plate 230 and restrain pivot plate 230 from leaving pivot cavity 240.

In various exemplary embodiments, at least surfaces 290 and 250 are provided with a low coefficient of friction material to allow pivotal movement in a horizontal plane about a vertical horizontal axis with little effort or force. A preferred material has a dynamic coefficient of friction of between about 0.05–0.4. This may be achieved, for example, by coating the surface with Teflon® (polytetrafluoroethylene) or other non-stick, low friction materials. However, values outside of this preferred range may be suitable for certain applications. Lower surface 260 may not need a low friction surface because when pressure is applied to the shoe sole during movement, support contact is typically only between surfaces 250 and 290, with surface 260 only supporting pivot plate 230 from forces of gravity when the sole 100 is elevated from a ground surface. Thus, surface 260 may not be considered a contact surface during use or rotation of the pivot assembly. However, when high pivot loads are applied, such as during the game of basketball and the like, it is likely that some twisting or rotation of sole element 210 and pivot plate 230 may occur, which would allow contact of the undersurface of pivot plate 230 with lower support surface 260. In such cases and applications, it may also be desirable to also coat the undersurface of pivot plate 230 and surface 260 with a low coefficient of friction material.

The inventive rotatable pivot assembly 200 is applicable for use on soles of most any type of shoe. They are particularly useful in athletic shoes, where extreme pivotal movement is likely to be encountered, such as in tennis or basketball shoes, for example. They are also particularly suited for use in work shoes for jobs, such as for example, cashiers or warehouse employees, that pivot frequently at their workstation. Thus, the inventive rotatable pivot assembly 200 and shoe sole 100 may be affixed to a shoe upper 300 to form a shoe as shown in FIG. 2. An exemplary shoe may incorporate a spring element 400 in the heel region, as described in more detail in Applicant's U.S. Pat. No. 5,435,079 entitled Spring Athletic Shoe and U.S. Design Pat. No. D434,548 entitled Shoe With Spring, both of which are incorporated herein by reference in their entirety.

In exemplary embodiments, external contact surface 220 of pivotal sole element 210 extends slightly below that of tread 110 of the remainder of sole 100. As such, most of the forces between the shoe and the ground act through external contact surface 220 of rotatable pivot assembly 200. When rapid or even slow pivotal movement of the shoe is desired, there will be little or no resistance given by sole surface 110 when the wearer leans toward the ball of the shoe to take weight off of the heel region. Instead, forces accumulate on the rotatable pivot assembly 200. Owing to the assembly's low coefficient of friction surfaces 290 and 250, such rotation can be achieved with greatly reduced input force. As a result, directional change of the shoe can be achieved with less effort and wear on both the shoe sole and the wearer's knees and ankles. Moreover, due to the thin nature of the pivot plate 230 and pivot cavity 240, the inventive rotatable pivot assembly 200 can be provided with minimal effect on the size, bulk and balance of the shoe sole. As such, the shoe sole can achieve improved pivotal movement while retaining the look and feel of a "normal" shoe, so as to maintain the balance, cushion, resilience and other attributes of a shoe when normal, non-pivotal movement is encountered. Thus, wearing of the shoe will not change a wearer's running or walking gait. Further, such a simple construction has only one moving part.

While this invention has been described in conjunction with the specific embodiments outline above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A shoe sole, comprising:

a main sole having a pivot cavity defined by an upper plate support surface and an annular lower plate support surface having an aperture therein, wherein the annular lower plate support surface has a first diameter, the aperture has a second diameter that is less than the first diameter, and a pivot cavity thickness is defined between the upper plate support surface and the annular lower plate support surface; and a rotatable pivot assembly including a sole element and a pivot plate rotatably pivotally constrained within said pivot cavity, said pivot plate having a third diameter that is greater than the second diameter and less than the first diameter, said pivot plate also having a thickness that is less than the pivot cavity thickness, said sole element having a fourth diameter that is less than the second diameter, said sole element extending through the aperture, a bottom surface of the sole element forming an external contact surface, wherein the pivot cavity thickness is between about 0.5 mm to 3.5 mm greater than the pivot plate thickness, such that the pivot plate is loosely received within the pivot cavity and the pivot plate has a solid, planar circular shape and a circular outer periphery and is supported solely near the outer periphery of the pivot plate.

2. The shoe sole according to claim 1, wherein said main sole has a bottom surface forming an external contact surface, said external contact surface of said sole element extending below said external contact surface of said main sole.

3. The shoe sole according to claim 2, wherein said external contact surface of said sole element extends below said external contact surface of said main sole by a distance of about 1 to 2.5 mm.

4. The shoe sole according to claim 1, wherein said pivot cavity thickness is between about 2 and 4.5 mm.

5. The shoe sole according to claim 1, wherein at least said upper plate support surface is formed from a low coefficient of friction material.

6. The shoe sole according to claim 5, wherein the coefficient of friction is less than about 0.4.

7. The shoe sole according to claim 5, wherein both said upper plate support surface and a top surface of said pivot plate are formed from a low coefficient of friction material.

8. The shoe sole according to claim 1, wherein the pivot plate is made of a rigid rubber.

9. The shoe sole according to claim 8, wherein a pivot cavity contact surface of the rubber is coated with polytetrafluoroethylene.

10. The shoe sole according to claim 4, wherein the pivot plate thickness is between about 1 and 4 mm.

11. The shoe sole according to claim 1, wherein said sole element is made of rubber.

12. The shoe sole according to claim 1, wherein said external contact surface of said main sole includes a tread pattern and the external contact surface of said sole element includes a complementary tread pattern.

13. The shoe sole according to claim 1, wherein said sole element is releasably attached to said pivot plate.

14. The shoe sole according to claim 1, wherein said sole element is circular.

15. The shoe sole according to claim 1, wherein a difference between the second diameter and the fourth diameter is less than about 2 mm.

16. The shoe sole according to claim 1, wherein the fourth diameter covers substantially an entire width of said main sole.

17. The shoe sole according to claim 16, wherein the difference between the width of the main sole and the fourth diameter is between about 4 and 15 mm.

18. A shoe, comprising:

a shoe upper;

a main sole attached to said shoe upper, said main sole having a pivot cavity defined by an upper plate support surface and an annular lower plate support surface having an aperture therein, wherein the annular lower plate support surface has a first diameter, the aperture has a second diameter that is less than the first diameter, and a pivot cavity thickness is defined between the upper plate support surface and the annular lower plate support surface; and a rotatable pivot assembly including a sole element and a pivot plate rotatably pivotally constrained within said pivot cavity, said pivot plate having a third diameter that is greater than the second diameter and less than the first diameter, said pivot plate also having a thickness that is less than the cavity thickness, said sole element having a fourth diameter that is less than the second diameter, said sole element extending through the aperture, a bottom surface of the sole element forming an external contact surface, wherein the pivot cavity thickness is between about 0.5 mm to 3.5 mm greater than the pivot plate thickness, such that the pivot plate is loosely received within the pivot cavity and the pivot plate has a solid, planar circular shape and a circular outer periphery and is supported solely near the outer periphery of the pivot plate.

19. The shoe according to claim 18, wherein the pivot cavity thickness is between about 2 and 4.5 mm.

20. The shoe according to claim 19, wherein the pivot plate thickness is between about 1 and 4 mm.

21. The shoe according to claim 18, wherein contact surfaces of said pivot plate and said pivot cavity are coated with a material having a low coefficient of friction.

22. The shoe according to claim 21, wherein the material is polytetrafluoroethylene.

23. The shoe according to claim 18, wherein a thickness of the sole element is selected so that an external contact surface of said sole element extends below said external contact surface of said main sole by a distance of about 1 to 2.5 mm.

24. The shoe according to claim 18, wherein the fourth diameter covers substantially an entire width of said main sole.

25. The shoe according to claim 24, wherein the difference between the width of the main sole and the fourth diameter is between about 4 and 15 mm.

26. A shoe sole, comprising:

a main sole having a pivot cavity defined by an upper plate support surface and an annular lower plate support surface having an aperture therein, wherein the annular lower plate support surface has a first diameter, the aperture has a second diameter that is less than the first diameter, and a pivot cavity thickness is defined between the upper plate support surface and the annular lower plate support surface; and a rotatable pivot assembly including a sole element having a first surface attached to a corresponding surface of a pivot plate, said pivot plate being rotatably pivotally constrained within said pivot cavity, said pivot plate having a third diameter that is greater than the second diameter and less than the first diameter, said pivot plate also having a thickness that is less than the pivot cavity thickness, said sole element having a fourth diameter that is less than the second diameter, said sole element extending through the aperture, a bottom surface of the sole element forming an external contact surface, wherein the pivot plate is flat and has a circular outer periphery and the pivot plate is supported solely near the outer periphery of the pivot plate.

27. The shoe sole according to claim 26, wherein the pivot plate is made from metal.

28. The shoe sole according to claim 26, wherein the pivot plate is made from hard plastic.

29. The shoe sole according to claim 26, wherein the upper plate support surface and the annular lower plate support surface are formed from rigid materials.

30. The shoe sole according to claim 26, wherein the sole element is formed from a material softer than the pivot plate.

31. A shoe, comprising:

a shoe upper;

a main sole attached to said shoe upper, said main sole having a pivot cavity defined by an upper plate support surface and an annular lower plate support surface having an aperture therein, wherein the annular lower plate support surface has a first diameter, the aperture has a second diameter that is less than the first diameter, and a pivot cavity thickness is defined between the upper plate support surface and the annular lower plate support surface; and a rotatable pivot assembly including a solo element having a first surface attached to a corresponding surface of a pivot plate, said pivot plate being rotatably pivotally constrained within said pivot cavity, said pivot plate having a third diameter that is greater than the second diameter and less than the first diameter, said pivot plate also having a thickness that is less than the pivot cavity thickness, said sole element having a fourth diameter that is less than the second diameter, said sole element extending through the aperture, a bottom surface of the sole element forming an external contact surface, wherein the pivot plate is flat and has a circular outer periphery and the pivot plate is supported solely near the outer periphery of the pivot plate.

32. The shoe according to claim 31, wherein the pivot plate is made from metal.

33. The shoe according to claim 31, wherein the pivot plate is made from hard plastic.

34. The shoe according to claim 31, wherein the upper plate support surface and the annular lower plate support surface are formed from rigid materials.

35. The shoe according to claim 31, wherein the sole element is formed from a material softer than the pivot plate.

36. A shoe sole, comprising:

a main sole having a pivot cavity defined by an upper plate support surface and an annular lower plate support surface having an aperture therein, wherein the annular lower plate support surface has a first diameter, the aperture has a second diameter that is less than the first diameter, and a pivot cavity thickness is defined between the upper plate support surface and the annular lower plate support surface; and a rotatable pivot assembly including a sole element having a first surface attached to a corresponding surface of a pivot plate, said pivot plate being rotatably pivotally constrained within said pivot cavity, said pivot plate having a third diameter that is greater than the second diameter and less than the first diameter, said pivot plate also having a thickness that is less than the pivot cavity thickness, said sole element having a fourth diameter that is less than the second diameter, said sole element extending through the aperture, a bottom surface of the sole element forming an external contact surface, wherein the pivot plate has a solid, planar circular shape with a circular outer periphery and the pivot plate is supported solely near the outer periphery of the pivot plate.

37. A shoe, comprising:

a shoe upper;

a main sole attached to said shoe upper, said main sole having a pivot cavity defined by an upper plate support surface and an annular lower plate support surface having an aperture therein, wherein the annular lower plate support surface has a first diameter, the aperture has a second diameter that is less than the first diameter, and a pivot cavity thickness is defined between the upper plate support surface and the annular lower plate support surface; and a rotatable pivot assembly including a sole element having a first surface attached to a corresponding surface of a pivot plate, said pivot plate being rotatably pivotally constrained within said pivot cavity, said pivot plate having a third diameter that is greater than the second diameter and less than the pivot first diameter, said pivot plate also having a thickness that is less than the pivot cavity thickness, said sole element having a fourth diameter that is less than the second diameter, said sole element extending through the aperture, a bottom surface of the sole element forming an external contact surface, wherein the pivot plate has a solid, planar circular shape and a circular outer periphery and the pivot plate is supported solely near the outer periphery of the pivot plate.

38. A shoe sole, comprising:

a main sole having a pivot cavity defined by an upper plate support surface and an annular lower plate support surface having an aperture therein, wherein the annular lower plate support surface has a first diameter, the aperture has a second diameter that is less than the first diameter, and a pivot cavity thickness is defined between the upper plate support surface and the annular lower plate support surface; and a rotatable pivot assembly including a sole element and a pivot plate rotatably pivotally constrained within said pivot cavity, said pivot plate having a third diameter that is greater than the second diameter and less than the first diameter, said pivot plate also having a thickness that is less than the pivot cavity thickness, said sole element having a fourth diameter that is less than the second diameter, said sole element extending through the aperture, a bottom surface of the sole element forming an external contact surface, wherein the pivot plate is flat and the pivot cavity thickness is greater than the pivot plate thickness by about 0.5 mm to 3.5 mm to loosely receive the pivot plate for pivotal rotation of the pivot plate within the pivot cavity, the pivot plate having a thickness of between 1 mm and 4 mm and a circular outer periphery and the pivot plate is supported solely near the outer periphery of the pivot plate.

39. A shoe, comprising:

a shoe upper; and a main sole attached to said shoe upper, said main sole having a pivot cavity defined by an upper plate support surface and an annular lower plate support surface having an aperture therein, wherein the annular lower plate support surface has a first diameter, the aperture has a second diameter that is less than the first diameter, and a pivot cavity thickness is defined between the upper plate support surface and the annular lower plate support surface; and a rotatable pivot assembly including a sole element and a pivot plate rotatably pivotally constrained within said pivot cavity, said pivot plate having a third diameter that is greater than the second diameter and less than the first diameter, said pivot plate also having a thickness that is less than, the pivot cavity thickness, said sole element having a fourth diameter that is less than the second diameter, said sole element extending through the aperture, a bottom surface of the sale element forming an external contact surface, wherein the pivot plate is flat and the pivot cavity thickness is greater than the pivot plate thickness by about 0.5 mm to 3.5 mm to loosely receive the pivot plate for pivotal rotation of the pivot plate within the pivot cavity, the pivot plate having a thickness of between 1 mm and 4 mm and has a solid, near circular shape and a circular outer periphery and the pivot plate is supported solely near the outer periphery of the pivot plate.

40. A shoe sole, comprising:

a main sole having a pivot cavity defined by an upper plate support surface and an annular lower plate support surface having an aperture therein, wherein the annular lower plate support surface has a first diameter, the aperture has a second diameter that is less than the first diameter, and a pivot cavity thickness is defined between the upper plate support surface and the annular lower plate support surface; and a rotatable pivot assembly including a sole element and a pivot plate rotatably pivotally constrained within said pivot cavity, said pivot plate having a third diameter that is greater than the second diameter and less than the first diameter, said pivot plate also having a thickness that is less than the pivot cavity thickness, said sole element having a fourth diameter that is less than the second diameter, said sole element extending through the aperture, a bottom surface of the sole element forming an external contact surface, wherein the pivot plate has a solid, planar circular shape and is loosely received within the pivot cavity for pivotal rotation of the pivot plate within the pivot cavity and the pivot plate has a circular outer periphery and is supported solely near the outer periphery of the pivot plate.

41. A shoe, comprising:

a shoe upper; and a main sole attached to said shoe upper, said main sole having a pivot cavity defined by an upper plate support surface and an annular lower plate support surface having an aperture therein, wherein the annular lower plate support surface has a first diameter, the aperture has a second diameter that is less than the first diameter, and a pivot cavity thickness is defined between the upper plate support surface and the annular lower plate support surface; and a rotatable pivot assembly including a sole element and a pivot plate rotatably pivotally constrained within said pivot cavity, said pivot plate having a third diameter that is greater than the second diameter and less than the first diameter, said pivot plate also having a thickness that is less than the pivot cavity thickness, said sole element having a fourth diameter that is less than the second diameter, said sole element extending through the aperture, a bottom surface of the sole element forming an external contact surface, wherein the pivot plate has a solid, planar circular shape and is loosely received within the pivot cavity for rotation of the pivot plate within the pivot cavity and the pivot plate has a circular outer periphery and is supported solely near the outer periphery of the pivot plate.

42. The shoe sole according to claim 1, wherein the pivot plate is flat.

43. The shoe according to claim 18, wherein the pivot plate is flat.

* * * * *